United States Patent [19]

Ilvespää et al.

[11] Patent Number: 5,044,094

[45] Date of Patent: Sep. 3, 1991

[54] DRYING SECTION APPARATUS FOR A PAPER MAKING MACHINE

[75] Inventors: Heikki Ilvespää; Reima Kerttula, both of Jyväskylä ; Allan Liedes, Palokka, all of Finland

[73] Assignee: Valmet Paper Machinery Inc., Finland

[21] Appl. No.: 570,129

[22] Filed: Aug. 20, 1990

[30] Foreign Application Priority Data

Aug. 31, 1989 [FI] Finland ..... 894084

[51] Int. Cl.[5] ..... F26B 11/02

[52] U.S. Cl. ..... 34/114; 34/116; 34/123

[58] Field of Search ..... 34/23, 111, 114, 113, 34/115, 116, 117, 122, 123

[56] References Cited

U.S. PATENT DOCUMENTS 4,441,263 4/1984 Vedenpaa ..... 34/123

4,602,439 7/1986 Eskelinen et al. ..... 34/23

4,953,297 9/1990 Eskelinen et al. ..... 34/114

*Primary Examiner*—James C. Yeung

*Attorney, Agent, or Firm*—Steinberg & Raskin

[57] ABSTRACT

The invention relates to an apparatus for use in the drying section of a paper machine, which apparatus comprises a drying cylinder group formed by drying cylinders and a roll group formed by rolls, preferably suction rolls located at a different height relative to the drying cylinders. The geometric rotational axis of the roll located in an area between two adjacent drying cylinders in a different height position is spaced away from the center plane between the center axes of the drying cylinders. The surface of the roll, preferably a suction roll, is adapted to be located as close to the surface of the drying cylinder on the web outgoing side of the roll as possible, whereby the free transfer distance of the outgoing side is minimized.

6 Claims, 2 Drawing Sheets

DRYING SECTION APPARATUS FOR A PAPER MAKING MACHINE

BACKGROUND OF THE INVENTION

The invention relates to an apparatus for the drying section of a paper machine.

A prior art apparatus has been used in the drying section of a paper or paperboard making machine, in which apparatus the web follows the drying fabric, preferably a felt, in such a way that on the bottom cylinders of a drying cylinder group the web runs as the outermost element, whereas on the top cylinders the web runs between a drying cylinder and a drying fabric. There thus exists a risk especially on the bottom cylinders of the loosening of the paper web, particularly at high web speeds. The web also tends to loosen from the surface of the drying fabric in the area of free transfer which occurs in the felt transfer between the top drying cylinder and the bottom roll.

The drying cylinder and the drying fabric induce an air flow that tends to loosen the web from the drying fabric. This loosening problem occurs especially at high web speeds near the top cylinders in a gap between the felt and the cylinder created by the free transfer of the web and felt between a drying cylinder and a roll at a different height. The longer the free transfer is, the more serious are instability problems and the tendency of the web to loosen from the felt surface.

When apparatuses for producing an underpressure zone over the felt and the web are used, the above-mentioned loosening problem can be eliminated. However, the apparatuses for producing the low air pressure zone require a lot of space, and the space problems in turn result in the cylinder distances having to be made relatively long for making the placement of massive suction boxes or beam constructions creating the underpressure zone possible in a space limited by the felt loop between the top cylinders and the bottom cylinders.

The aforementioned prior art apparatuses are described e.g. in U.S. Pat No. 4,809,445. This patent illustrates a suction box apparatus in which the suction box is fitted on the incoming side of the web in the felt transfer between the top cylinder and the bottom roll. The ascending web and the felt transfer from the bottom roll back to the second upper drying cylinder are, in contrast, not provided with a suction box and the loosening problems of the web are more pronounced during this long free transfer area.

SUMMARY OF THE INVENTION

In view of the above, an object of the invention is to improve the free transfer of a paper web between upper and lower cylinders of a drying section of a paper making machine. The invention is based on a solution, in which a roll, e.g., a suction roll, between the drying cylinders is located in such a way that it is spaced away from the center plane between the drying cylinders, whereby the roll, preferably a suction roll, is fitted asymmetrically relative to the drying cylinders.

In accordance with the invention, the roll is spaced away from this center plane in such a way that the length of the transfer of the drying fabric and the web between a drying cylinder to the asymmetrically located roll to another drying cylinder is limited. The surface of the roll, preferably a suction roll, is according to the invention located as close to the second drying cylinder as possible. The distance between the roll and the drying cylinder is preferably within the range of 30 to 100 mm and most preferably in the range of 50 to 75 mm. Similarly, the longer free transfer of the group from the first drying cylinder to the roll, preferably a suction roll, is provided with an underpressure apparatus located on one side of the drying fabric, preferably with an apparatus producing a blowing and thereby an underpressure zone.

The web incoming side of the roll is thus furnished with an apparatus producing an underpressure zone, whereas the outgoing side is not provided with this equipment producing an underpressure (low air pressure) zone or partial vacuum. The instability is minimized by minimizing the distance of the free transfer of the felt and the web on the web outgoing side of the roll.

The inventive apparatus in the drying section of a paper making machine is mainly characterized in that the geometric rotational axis of a roll located in an area between two drying cylinders at a different height is located, relative to the center plane between the center axes of the two drying cylinders, spaced from the center plane and thereby asymmetrical relative to the drying cylinders and that the surface of the roll is located as close to the surface of the drying cylinder of the web outgoing side as possible, whereby the free transfer of the web at the outgoing side is minimized. This free transfer of the outgoing side does not comprise means for producing an underpressure.

BRIEF DESCRIPTION OF THE DRAWINGS

The invention is next described with reference to the inventive preferred embodiments shown in the figures of the accompanying drawings, to which embodiments the invention is not solely intended to be limited.

DESCRIPTION OF THE PREFERRED EMBODIMENTS

Figure 1:
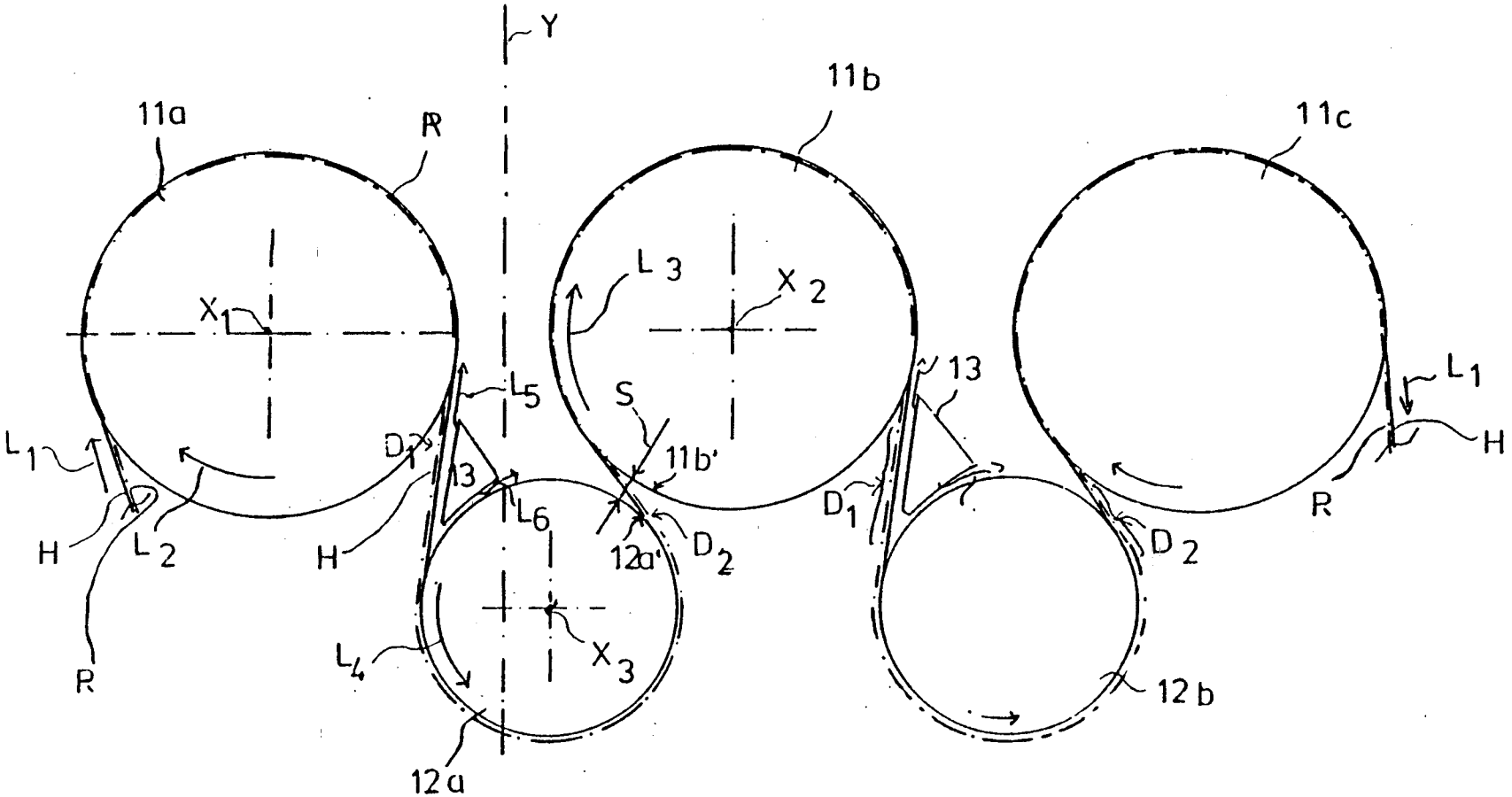
FIG. 1 shows the drying section apparatus of a paper or paperboard machine in accordance with a preferred embodiment of the invention.

FIG. 1 shows an inventive drying section apparatus of a paper making machine. In the embodiment of FIG. 1, the drying group comprises drying cylinders 11*a*, 11*b*, 11*c* in the first uppermost row of the drying group and lower rolls, preferably suction rolls 12*a*, 12*b*, 12*c* in the lowermost row of the drying group. The invention is below described with reference to the upper drying cylinders 11*a* and 11*b* of the drying group as well as to the roll 12*a* of the lower rolls of the drying group.

The drying fabric H travels with the web R from the upper drying cylinders of the drying group via the bottom rolls back to the upper cylinders of the drying group. At the drying cylinders 11*a* and 11*b*, the web R travels between a drying cylinder surface and the drying fabric H, and at the lower rolls 12 the drying fabric H travels according to the surface of the bottom roll, whereby the web R runs as the outermost element and is thereby unsupported from the outside.

The web R is thus not provided with an outer support when moving from the drying cylinder 11*a* to the roll 12*a*, and correspondingly, when moving further from the roll 12*a* to the drying cylinder 11*b*. The felt and web travel has been indicated by the arrow $L_1$ and the rotational direction of the rolls is correspondingly indicated by the arrows $L_2$, $L_3$ and $L_4$.

In FIG. 1, $X_1$ and $X_2$ refer to the geometric rotational axes of the drying cylinders 11*a* and 11*b*. The center plane of the distance between these rotational axes is marked in the figure by Y. In accordance with the invention, the geometric rotational and center axis $X_3$ of the roll 12*a* is sited asymmetrically relative to the drying cylinders 11*a* and 11*b* and thus located at a distance from the center plane Y.

In accordance with the invention, the surface of roll 12*a* is fitted as close to the drying cylinder 11*b* as possible. The shortest distance between the respective surfaces 12' and 11' of the roll 12*a* and the drying cylinder 11*b* is marked by the letter S, which is within the range of 30 to 100 mm and most preferably within the range of 50 to 75 mm. This makes the free travel distance $D_2$ of the web after it leaves roll 12*a* as short as possible, which means that the instability problems of the web travel on the outgoing side of the roll 12*a* have been minimized. On the web incoming side of roll 12*a* is formed, in contrast, as open a space as possible for placing the apparatus 13 producing an underpressure zone in the vicinity of the incoming side of the felt and the web to direct the underpressure over the felt and the web for keeping the web on the felt in the area of the free transfer $D_1$ of the web incoming side of roll 12*a*. The apparatus 13 may comprise means for producing blast air $L_5$. The air flow $L_5$ further reduces the air pressure in the vicinity of the felt H which produces a pressure difference over the felt and the web and keeps the web R on the felt H also in the area of the felt transfer distance D.

Figure 2:
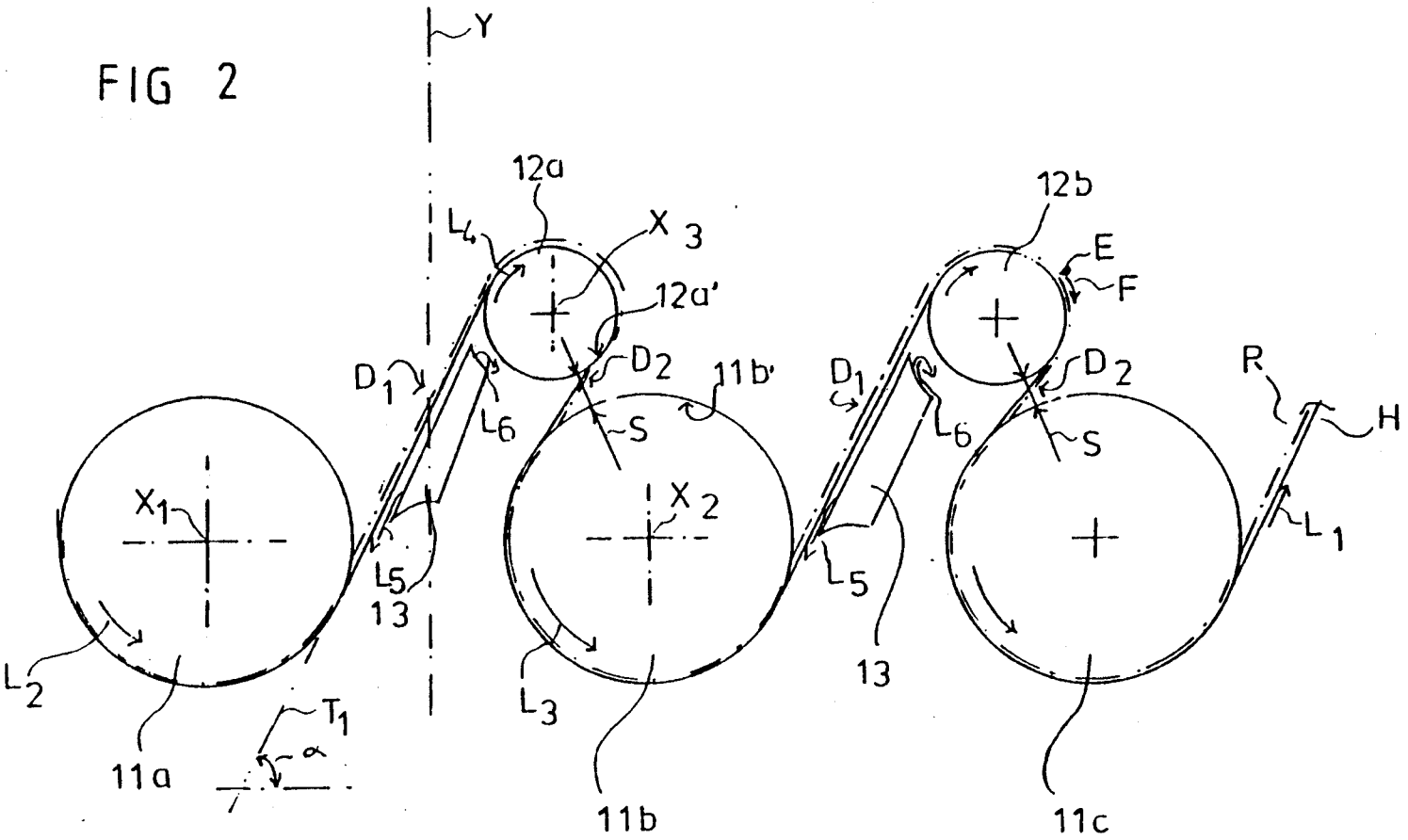
FIG. 2 shows a second preferred embodiment of the invention.

FIG. 2 shows a second preferred embodiment of the inventive equipment, which Figure is similar to an inverted image of the embodiment of FIG. 1. In the embodiment of FIG. 2, the suction rolls 12*a*, 12*b*, 12*c* are located above the drying cylinders 11*a*, 11*b*.

According to FIG. 2, the means 13 producing the underpressure are located in the vicinity of the transfer $D_1$ of the incoming side of the felt and the web, causing an underpressure zone over the felt and the web, whereby the web remains tightly on the felt surface. Similarly, the length of the free transfer $D_2$ of the outgoing side is minimized by bringing the roll 12*a* as close to the lower second drying cylinder 11*b* as possible and in such a way that the center axis of the roll 12*a* (the geometric rotational axis X) is located asymmetrically relative to the cylinders 11*a* and 11*b* and spaced from the center plane Y therebetween. The Figure illustrates that the plane $T_1$ of the transfer $D_1$ of the web incoming side of roll 12*a* is located diagonally relative to the horizontal plane, where the transfer is at an angle $\alpha$ with respect to the horizontal plane and where the angle $\alpha$ is preferably within the range of 20° to 60° and most preferably approximately 45°.

In the embodiment of FIG. 2 secure transfer of the paper is ensured in all conditions. Since the transfers to the web incoming side of the roll are diagonal, any paper mass possibly fallen off the top roll 12*a* rises along with the transfer to the second top roll 12*b* and the broke E of the paper web shown in the Figure is carried along by the felt and web and does not fall between the parts of machine and thus cause a need for cleaning. The Figure shows, by means of the arrow F, how this paper mass travels further along the entire length of the drying cylinder transfer. In accordance with FIG. 2, the apparatus 13 producing the underpressure produces a blowing in the directions $L_5$ and $L_6$. A blowing in the direction $L_5$ produces a suction between the blowing box and the felt H, producing in this space an underpressure, which affects the felt and the web and keeps the web tightly on the surface of the felt H. The Figure shows that the free transfer distance D of the outgoing side is minimized by bringing the roll 12*a* as close to the drying cylinder as possible and locating roll 12*a* at a distance from the center plane Y between the drying cylinders 11*a* and 11*b*. By means of this asymmetric placement, the drying cylinder 11*b* and the roll 12*a*, preferably a suction roll, can be brought as close to each other as possible in such a way that the distance L between the surfaces of said rolls remains in the range of 30 to 100 mm and most preferably within the range of 50 to 75 mm.

What is claimed is:

1. A drying section apparatus for a paper making machine comprising:

a plurality of drying cylinders, each of said drying cylinders located substantially at the same height;

a plurality of rolls, each of said plurality of rolls located at substantially the same height as each other and at a different height than said plurality of drying cylinders;

at least one of said rolls located such that its rotational axis is spaced away from a center plane between the center axes of two adjacent said drying cylinders such that a paper web supported by a drying fabric and outside of said drying fabric as it passes from the periphery of a first of said two adjacent drying cylinders to the periphery of a second of said two adjacent drying cylinders passes only a minimal distance between the surface of said roll and the surface of said second drying cylinder said minimal distance being between about 20 to 100 mm; and means for producing an under pressure condition on said web and said drying fabric as they pass from said first of said two adjacent drying cylinders to the periphery of said roll.

2. The drying section of claim 1 wherein said at least one roll is a suction roll.

3. The drying section apparatus of claim 1, wherein the minimal distance between the surface of said roll and the surface of said second cylinder is within the range of 50 to 75 mm.

4. The drying section apparatus of claim 1, wherein said plurality of drying cylinders are at a lower height than said plurality of rolls and wherein said paper web and said supporting fabric are transferred upward from one of said plurality of drying cylinders to one of said rolls at an acute angle relative to the horizontal plane such that pieces of paper broke are carried along by said paper web and said drying fabric so as not to fall between respective parts of said drying section.

5. The drying section of claim 4, wherein said acute angle is within the range of 50° to 60°.

6. The drying section of claim 5, wherein said acute angle is approximately 45°.

* * * * *